US005268720A

United States Patent [19]

Saitoh et al.

[11] Patent Number: 5,268,720

[45] Date of Patent: Dec. 7, 1993

[54] ELECTROPHOTOGRAPHIC RECORDING APPARATUS HAVING MAGAZINE UNIT FOR STORING DEVELOPER

[75] Inventors: Hiroshi Saitoh, Ayase; Shiroh Kondoh, Atsugi; Masanori Yoshimura, Isebara; Yozo Matsuura, Machida, all of Japan

[73] Assignee: Ricoh Company, Ltd., Tokyo, Japan

[21] Appl. No.: 824,092

[22] Filed: Jan. 22, 1992

[30] Foreign Application Priority Data

Jan. 23, 1991 [JP] Japan ..... 3-6469
Apr. 26, 1991 [JP] Japan ..... 3-96936

[51] Int. Cl.[5] ..... G03G 15/06

[52] U.S. Cl. ..... 355/246; 355/260; 355/298

[58] Field of Search ..... 355/246, 260, 298, 245

[56] References Cited

U.S. PATENT DOCUMENTS

| | | | |
|---|---|---|---|
| 4,734,737 | 3/1988 | Koichi | 355/246 X |
| 4,860,056 | 8/1989 | Kano et al. | 355/298 |
| 4,862,209 | 8/1989 | Sakamoto et al. | 355/298 X |
| 4,888,620 | 12/1989 | Fujino et al. | 355/260 X |
| 4,916,490 | 4/1990 | Tanaka et al. | 355/260 X |
| 5,070,368 | 12/1991 | Okano et al. | 355/246 |
| 5,075,726 | 12/1991 | Itaya et al. | 355/246 |
| 5,095,331 | 3/1992 | Takano | 355/246 X |
| 5,126,799 | 6/1992 | Matsuura et al. | 355/298 |

*Primary Examiner*—Fred L. Braun

*Attorney, Agent, or Firm*—Oblon, Spivak, McClelland, Maier & Neustadt

[57] ABSTRACT

A recording apparatus which includes a photosensitive member and an image forming unit for forming a latent image on the photosensitive member. A developing unit develops this latent image by supplying toner to the photosensitive member so that a visible image corresponding to the latent image is formed on the photosensitive member. A transfer unit transfers the visible image from the photosensitive member to a recording sheet. A magazine unit having a first chamber for storing toner and a second chamber for storing scrap toner obtained by scraping residual toner from the photosensitive member is also provided. The magazine unit is detachably mounted to a housing of the recording apparatus. A supply mechanism supplies toner from the first chamber of the magazine unit to the developing unit. A detector detects whether an amount of toner in the developing unit is equal to or less than a predetermined amount and a controller activates the supply mechanism when the detector detects that the amount of toner is equal to or less than the predetermined amount. The supply mechanism features a gutter with a groove for accommodating developer and a rotation mechanism for rotating the gutter at an appropriate timing to deposit the developer in the gutter into the developing unit. A shutter which is opened when the magazine unit is mounted in the housing of the recording apparatus and which is closed when the magazine unit is removed from the housing may also be provided.

7 Claims, 12 Drawing Sheets

ELECTROPHOTOGRAPHIC RECORDING APPARATUS HAVING MAGAZINE UNIT FOR STORING DEVELOPER

BACKGROUND OF THE INVENTION (1) Field of the Invention

The present invention generally relates to an electrophotographic recording apparatus having a magazine unit for storing developer such as toner, and more particularly to an electrophotographic recording apparatus having a magazine unit for storing developer that can be easily replaced by a user.

(2) Description of Related Art

In a general electrophotographic recording apparatus, an electrostatic latent image is formed, by an optical writing process, on a precharged photosensitive member (e.g. a belt shaped photosensitive member), toner (developer) is then adhered to the electrostatic latent image by a developing unit so that a toner image is formed on the photosensitive member. The toner image is transferred from the photosensitive member to a recording sheet fed to the photosensitive member. The recording sheet is heated so that the toner thereon is fused and fixed. After this, the recording sheet on which the toner image is fixed is ejected from a housing of the electrophotographic recording apparatus.

After the toner image is transferred to the recording sheet, an amount of toner remains on the photosensitive member. The toner remaining on the photosensitive member is referred to as residual toner. The residual toner is scraped from the photosensitive member and then withdrawn as scrap toner. A residual charge on the photosensitive member is discharged by lighting.

Recent electrophotographic recording apparatus of this type can perform hundreds or thousands of printings, in a case where A4 sized recording paper is used, without changing the photosensitive member and the developing unit. However, as miniaturizing has been required recently, a toner supply tank used for supplying toner to the developing unit and a toner withdrawing tank used for withdrawing the scrap toner cannot be made large. Thus, users of this type of electrophotographic recording apparatus must resupply new toner thereto and withdraw the scrap toner.

Thus, the inventors of the present application have proposed a cleaner-toner-magazine (CTM) in which the tone supply tank and the toner withdrawing tank are integrated with each other. The CTM can be changed to a new one so that operations for resupplying new toner and for withdrawing the scrap toner become simple.

A description will now be given of the CTM which has been proposed by the inventors with reference to FIGS. 1 and 2.

Referring to FIG. 1, which shows a recording unit having the CTM, a photosensitive belt 1 circularly moves at a constant speed in a direction shown by the arrow. A precharger unit 2, a developing unit 7 and a transfer charger unit 9 are arranged around the photosensitive belt 1 in this order according to the electrophotographic process. The precharger unit 2 uniformly electrifies a surface of the photosensitive belt 1. An optical writing part 3 is provided between the precharger unit 2 and the developing unit 7. A laser beam is emitted from a laser unit 4 modulated in accordance with image signals. The laser beam passes via a polygonal mirror 5 and a mirror 6 and projects onto the surface of the photosensitive belt 1 via the optical writing part 3. Thus the photosensitive belt 1 is exposed by the laser beam, so that an electrostatic latent image is formed on the photosensitive belt 1. The developing unit 7 supplies toner to the photosensitive belt 1 in order to develop the electrostatic latent image. The toner supplied to the photosensitive belt 1 is adhered to the electrostatic latent image so that a toner image is formed on the photosensitive belt 1. A paper cassette 14 having recording papers is detachably mounted in a housing (not shown) of the recording unit. The recording paper is fed one by one from the paper cassette 14 toward the transfer charger unit 9. The toner image is transferred from the photosensitive belt 1 to a recording paper by the transfer charger unit 9. The recording paper passing through the transfer charger unit 9 is supplied to a fuser unit 10 so that the toner image is fused and fixed onto the recording paper. The recording paper is then ejected from the housing of the recording unit.

A CTM (Cleaner-Toner-Magazine) 20 is mounted on a downstream side of the transfer charger unit 9 in a direction in which the photosensitive belt 1 is circularly moved. The CTM 20 has a toner supply chamber 8 and a toner withdrawing chamber 12. A cleaning blade 11 is provided in the toner withdrawing chamber 12 so as to scrape the residual toner from the photosensitive belt 1. The residual toner scraped by the cleaning blade 11 is stored in the toner withdrawing chamber 12 of the CTM 20. Toner has been previously stored in the toner supply chamber 8 of the CTM 20. A discharger unit 13 is provided between the precharger unit 2 and the CTM 20. The discharger unit 13 emits a light onto the surface of the photosensitive belt 1 so that the residual charge is removed from the surface of the photosensitive belt 1.

The CTM 20 can be easily replaced by a user. However, as the CTM 20 and the developing unit 7 are separated from each other, mechanisms for conveying toner from the toner supply chamber 8 of the CTM 20 to the developing unit 7 must be provided. The mechanisms are formed, for example, as follows.

An ejecting mechanism 22 is provided in the toner supply chamber 8 of the CTM. The ejecting mechanism 22 has a conveyor for conveying the toner in the toner supply chamber 8 toward an outlet 21 which is formed on a side end of the toner supply chamber 8. Thus, the toner in the toner supply chamber 8 is ejected therefrom via the outlet 21 by the ejecting mechanism 22. A conveyor mechanism 23 is provided between the outlet 21 of the toner supply chamber 8 and an inlet of the developing unit 7. Thus, the conveyor mechanism 23 conveys the toner from the outlet of the toner supply chamber 8 of the CTM 20 to the inlet of the developing unit 7. A supplying mechanism 24 is provided in the developing unit 7. The supplying mechanism 24 has a conveyor extending in a direction approximately parallel to a width of the photosensitive belt 1. That is, the supplying mechanism 24 conveys the toner from the inlet in a main scanning direction s that the toner can be supplied, uniformly distributed in the main scanning direction, from the developing unit 7 to the photosensitive belt 1.

FIG. 2 shows a modification of the recording unit having the CTM 20.

Referring to FIG. 2, the CTM 20 is mounted so that the toner supply chamber 8 and the developing unit 7 are arranged in a direction approximately parallel to a vertical direction. The outlet 21 of the toner supply chamber 8 of the CTM 20 and the inlet of the developing unit 7 are connected to each other by a duct 26. The toner is supplied, by free fall, from the toner supply chamber 8 to the developing unit 7 via the duct 26. By implementing the modification shown in FIG. 2, the conveyor mechanism 23, shown in FIG. 1, for conveying the toner from the toner supply chamber 8 to the developing unit 7 can be omitted.

In the recording units shown in FIGS. 1 and 2, when the toner in the toner supply chamber 8 of the CTM 20 is used up, the toner withdrawing chamber 12 of the CTM 20 is filled with the scrap toner. In this state, the CTM 20 is changed to a new one. That is, by changing only the CTM 20, new toner can be resupplied to the recording unit and the scrap toner can e withdrawn therefrom.

Conventionally, however, a process for supplying the toner from the toner supply chamber 8 of the CTM 20 to the developing unit 7 has not been definitely decided upon. In addition, users cannot know that the toner in the toner supply chamber of the CTM is used up until the quality of images formed on the recording sheets deteriorates.

SUMMARY OF THE PRESENT INVENTION

Accordingly, a general object of the present invention is to provide an electrophotographic recording apparatus having a magazine unit for storing developer in which the disadvantages described above are eliminated.

A more specific object of the present invention is to provide an electrophotographic recording apparatus having a magazine unit for storing developer in which apparatus the developer can be supplied from the magazine unit to a developing unit in accordance with the amount of developer remaining in the developer unit.

The above objects of the present invention are achieved by a recording apparatus for recording images in accordance with an electrophotographic process, the recording apparatus comprising: a photosensitive member; an image forming unit for optically forming a latent image on a surface of the photosensitive member; a developing unit for developing the latent image by supplying developer to the surface of the photosensitive member so that a visible image corresponding to the latent image is formed on the surface of the photosensitive member; a transfer unit for transferring the visible image from the photosensitive member to a recording sheet; a magazine unit having a first chamber for storing developer and a second chamber for storing scrap developer, the second chamber being provided with a cleaning unit exposed from an opening formed on the magazine unit, and residual developer being scraped from the photosensitive member by the cleaning unit immediately after a process in the transfer unit entering, as the scrap developer, into the second chamber via the opening, the magazine unit being detachably mounted in a housing of the recording apparatus; a supplying mechanism for supplying the developer from the first chamber of the magazine unit to the developing unit; detecting means for detecting that an amount of developer in the developing unit is equal to or less than a predetermined amount; and control means for activating the supplying means when the detecting means detects that the amount of developer in the developing unit is equal to or less than the predetermined amount.

According to the present invention, as the developer is supplied from the magazine unit to the developing unit only when the amount of developer in the developing unit is equal to or less than a predetermined amount, the amount of developer can be supplied from the magazine unit to a developing unit in accordance with the amount of developer remaining in the developer unit.

Another object of the present invention is to provide an electrophotographic recording apparatus having a magazine unit for storing developer in which apparatus users can easily know a time at which the magazine must be replaced.

The above objects of the present invention are achieved by the recording apparatus further comprising a display unit for displaying messages; first determining means for determining whether or not the developer in the first chamber of the magazine unit is used up; and first display control means for controlling the display unit so that a first message is displayed on the display unit when the first determining means determines that the developer in the first chamber of the magazine unit is used up.

According to the present invention, as the first message is displayed on the display unit when the developer member in the magazine unit is used up, the user can recognize a time at which the magazine must be changed to a new one, by simply seeing the first message on the display unit.

Another object of the present invention is to provide an electrophotographic recording apparatus having a magazine for storing developer in which apparatus operations for changing the magazine unit are easy.

The above objects of the present invention are achieved by a recording apparatus for recording images in accordance with an electrophotographic process, the recording apparatus comprising: a photosensitive member; an image forming unit for optically forming a latent image on a surface of the photosensitive member; a developing unit for developing the latent image by supplying developer to the surface of the photosensitive member so that a visible image corresponding to the latent image is formed on the surface of the photosensitive member; a transfer unit for transferring the visible image from the photosensitive member to a recording sheet; a magazine unit having a first chamber for storing developer and a second chamber for storing scrap developer, the second chamber being provided with a cleaning unit exposed from an opening formed on the magazine unit, and residual developer being scraped from the photosensitive member by the cleaning unit immediately after a process in the transfer unit entering, as the scrap developer, into the second chamber via the opening, the magazine unit being detachably mounted in a housing of the recording apparatus; and a supplying mechanism for supplying the developer from the first chamber of the magazine unit to the developing unit; wherein the magazine unit further comprises a shutter provided at the opening from which the cleaning unit is exposed, and wherein the recording apparatus further comprises a mechanism for opening the shutter under a condition in which the magazine unit is mounted in the housing of the recording apparatus and for closing the shutter in a case where the magazine unit is removed from the housing.

According to the present invention, as the shutter is closed when the magazine unit is removed from the housing of the recording unit, the scrap developer in the second chamber of the magazine unit is prevented from scattering from the opening. Thus, the user can easily change the magazine unit to a new one.

Additional objects, features and advantages of the present invention will become apparent from the following detailed description when read in conjunction with the accompanying drawings.

DESCRIPTION OF THE PREFERRED EMBODIMENTS

Figure 3:
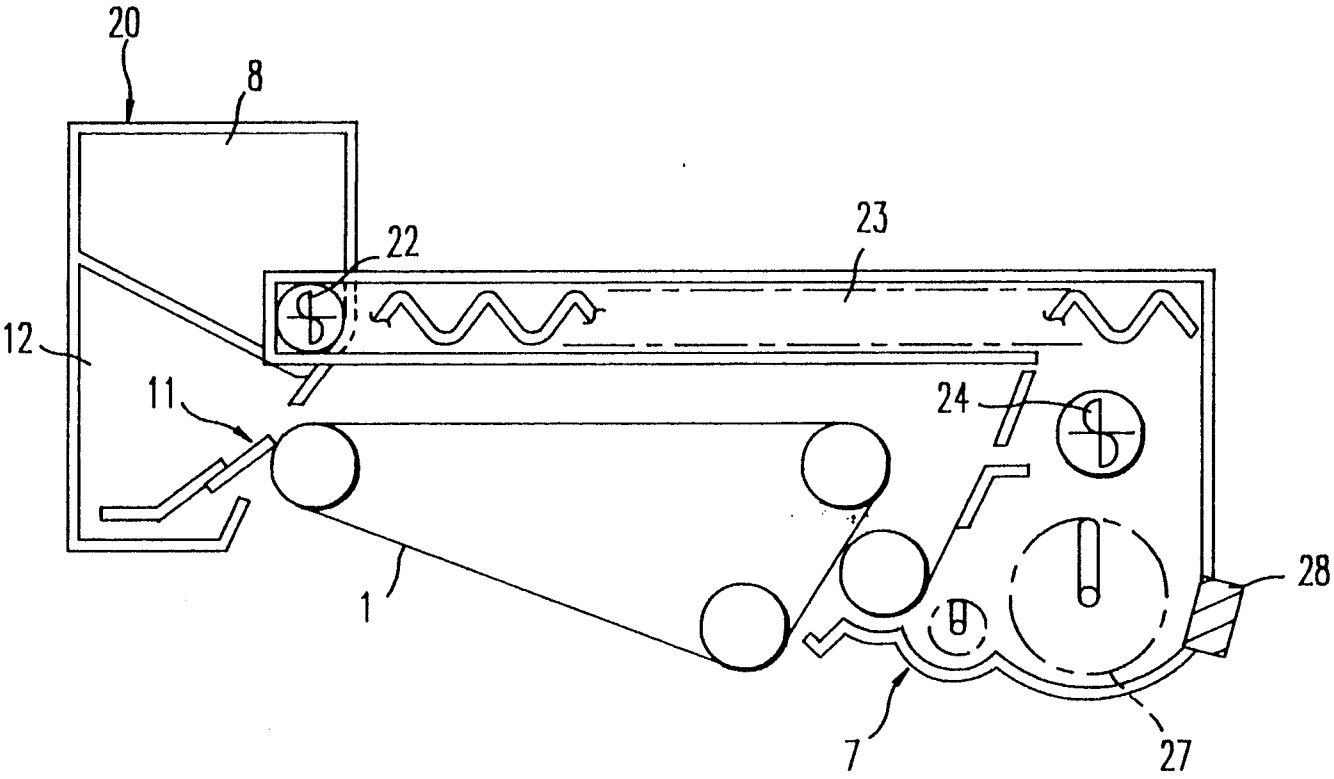
FIG. 3 is a cross sectional view illustrating a recording unit according to a first embodiment of the present invention.

A description will now be given of a first embodiment of the present invention with reference to FIGS. 3 through 6B. In FIG. 3 showing a structure of a recording unit, those parts which are the same as those shown in FIG. 1 are given the same reference numbers.

Figure 1:
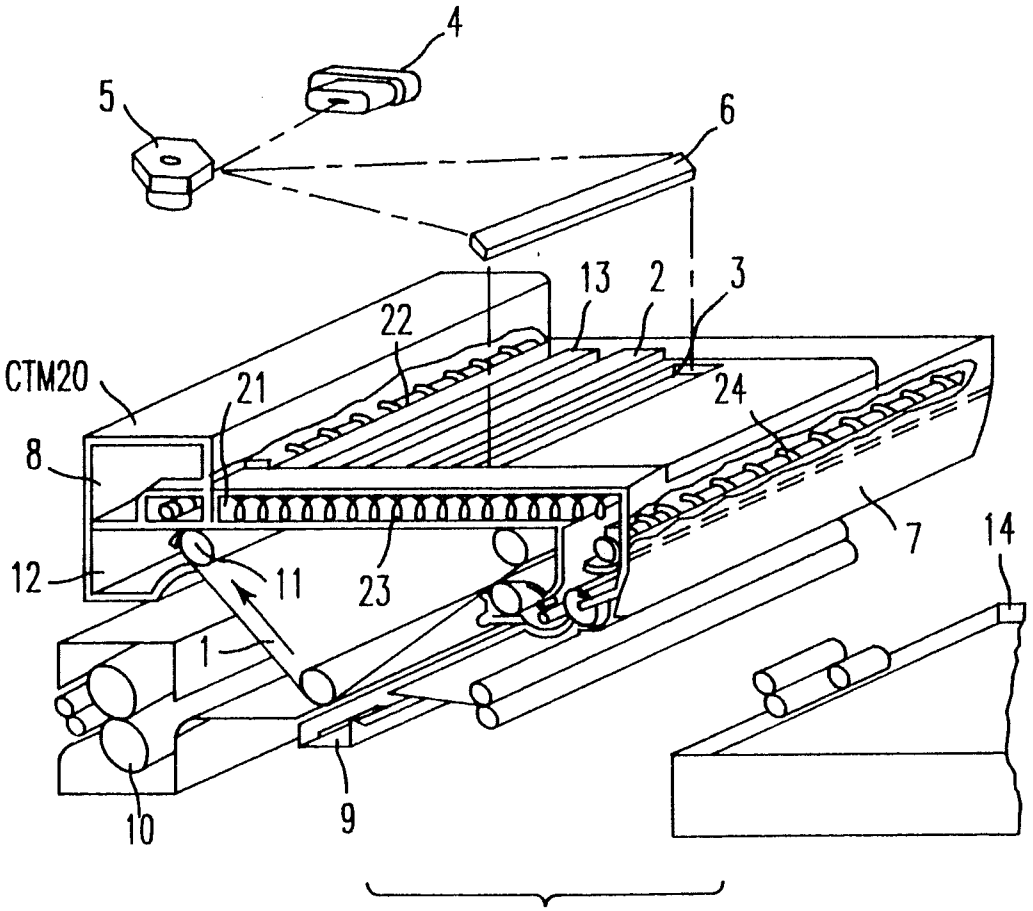
FIG. 1 PRIOR ART
FIG. 1 is a perspective view illustrating a recording unit having a cleaner toner magazine (CTM) in which a toner supply chamber and a toner withdrawing chamber are formed.

Referring to FIG. 3, the CTM 20 and the developing unit 7 are arranged around the photosensitive belt 1, which is circularly moved, in the same manner as those shown in FIG. 1. The CTM 20 has the toner supply chamber 8 and the toner withdrawing chamber 12. The cleaning blade 11 is provided in the toner withdrawing chamber 12. The ejecting mechanism 22 for ejecting the toner is provided in the toner supply chamber 8. The conveyor mechanism 23 connects the toner supply chamber of the CTM 20 and the developing unit 7 to each other in the same manner as that shown in FIG. 1. The supplying mechanism 24 is provided in the developing unit 7.

The developing unit 7 has a toner storage part 27. A toner sensor 28 is mounted on the toner storage part 27. The toner sensor 28 is, for example, a piezoelectric-sensor. The toner sensor 28 may also be a micro-switch for detecting load, a photo-sensor or the like. The toner sensor 28 outputs a detection signal corresponding to the amount of toner stored in the toner storage part 27.

Figure 4:
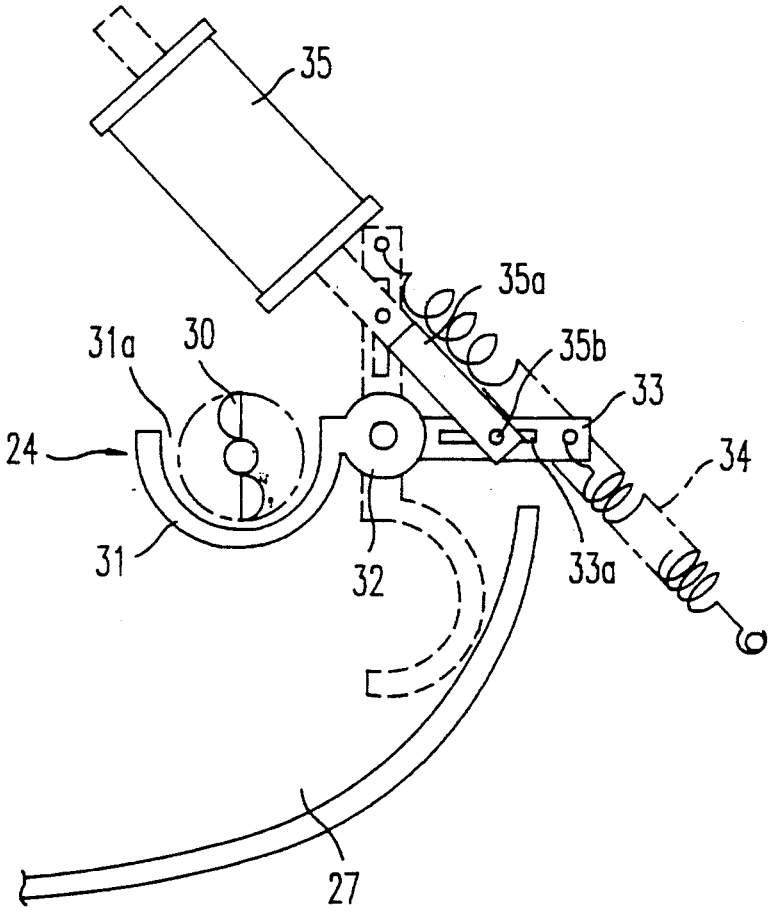
FIG. 4 is a cross sectional view illustrating a supply mechanism for supplying toner to a developing unit shown in FIG. 3.

The supplying mechanism 24 provided in the developing unit 7 is formed, for example, as shown in FIG. 4. The supplying mechanism 24 shown in FIG. 4 can supply toner to the toner storage part 27 of the developing unit 7 so that the distribution of toner in the toner storage part 27 is uniform in the main scanning direction parallel to the width of the photosensitive belt 1.

Referring to FIG. 4, the supplying mechanism 24 has a gutter member 31 on which a groove 31*a* is formed so as to extend in the main scanning direction and a screw 30 is provided in the groove 31*a* of the gutter member 31. When the screw 30 is rotated, the toner is conveyed along the groove 31*a* of the gutter member 31. The gutter member 31 is rotatably supported by a shaft 32 parallel to the main scanning direction, so that the gutter member 31 can be rotated around the shaft 32 in a direction perpendicular to the main scanning direction. An arm 33 supported by the shaft 32 projects from a part of the gutter member 31 so as to be opposite to the groove 31*a*. The arm 33 has a slit 33*a* extending in a direction parallel thereto. A solenoid actuator 35 is provided in a housing of the developing unit 7. A pin 35*b* is mounted on an end of a plunger 35*a* of the solenoid actuator 35. The pin 35*b* is slidably engaged with the slit 33*a* of the arm 33. A spring 34 is provided between an end of the arm 33 and a predetermined position of the housing. When the solenoid actuator 35 is turned off, the gutter member 31 is maintained in a horizontal state, by a force of the spring 34, as shown by a solid line in FIG. 4. When the solenoid actuator 35 is turned on, the plunger 35*b* is pulled by the solenoid actuator 35. In this case, the gutter member 31 is rotated around the shaft 32, so that the gutter member 31 is maintained in a vertical state as shown by a dashed line in FIG. 4. When the gutter member 31 is rotated, the toner in the groove 31*a* of the gutter member 31 (which toner is kept at a constant amount) falls to the storage part 27 of the developing unit 7.

A control system for controlling the recording unit having the structure described above is formed, for example, as shown in FIG. 5.

Figure 5:
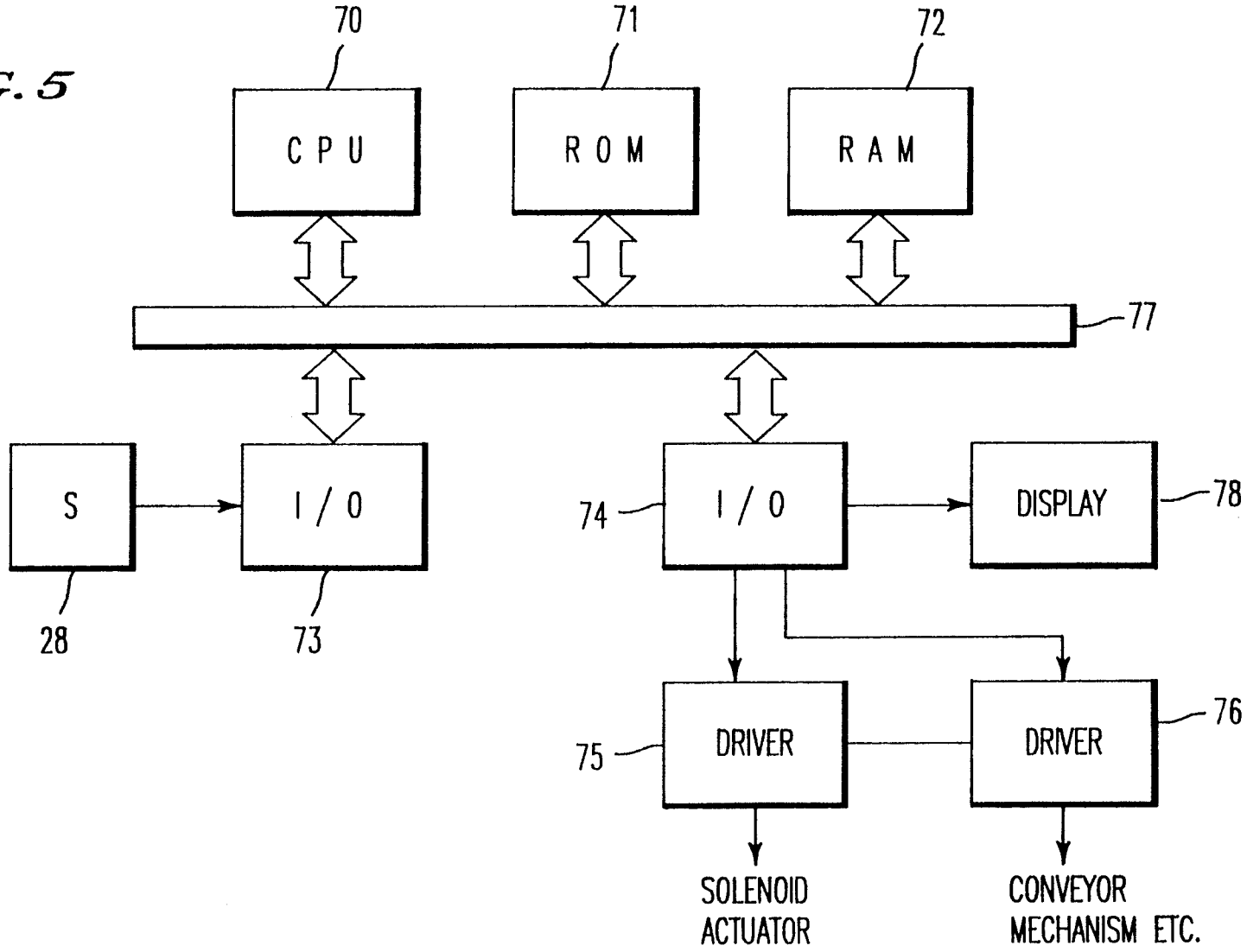
FIG. 5 is a block diagram illustrating a control system for controlling conveyor mechanisms for conveying the toner from a magazine to the developing unit and the supply mechanism shown in FIG. 4.

Referring to FIG. 5, the controller system has a CPU 70 (Central Processing Unit), a ROM 71 (Read Only Memory), a RAM 72 (Random Access Memory), an input interface 73, and an output interface 74 which are connected to each other by a bus 77. The ROM 71 stores programs, tables and the like. The RAM 72 stores data and the like calculated in this system. The CPU 70 carries out predetermined processes in accordance with the programs stored in the ROM 71. The toner sensor 28 is connected to the input interface 73 so that detection signals output from the toner sensor 28 are supplied to the CPU 70 via the input interface 73 and the bus 77. A first driver 75 for driving the solenoid actuator 35 and a second driver 76 for driving the ejecting mechanism 22, the conveyor mechanism 23 and the conveyor 30 of the supplying mechanism 24 are connected to the output interface 74, so that the solenoid actuator 35, the conveyor mechanism 23, etc. are driven in accordance with instructions from the CPU 70. A display unit 78 is also connected to the output interface 74 so that various messages are displayed on the display unit 78 in accordance with instructions from the CPU 70.

Figure 6A:
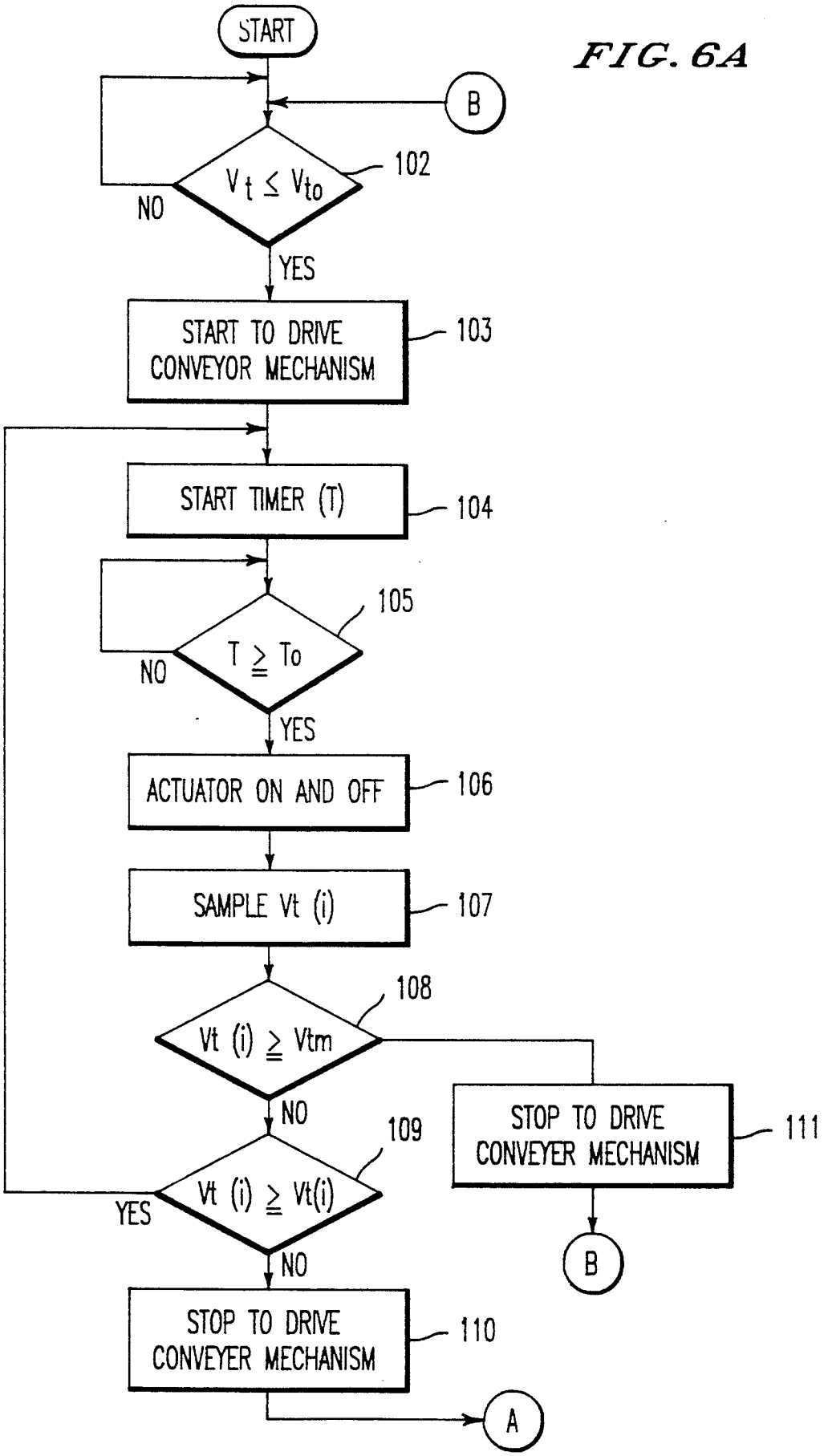
FIGS. 6A and 6B are flow charts illustrating processes carried out by the control system shown in FIG. 5.
Figure 6B:
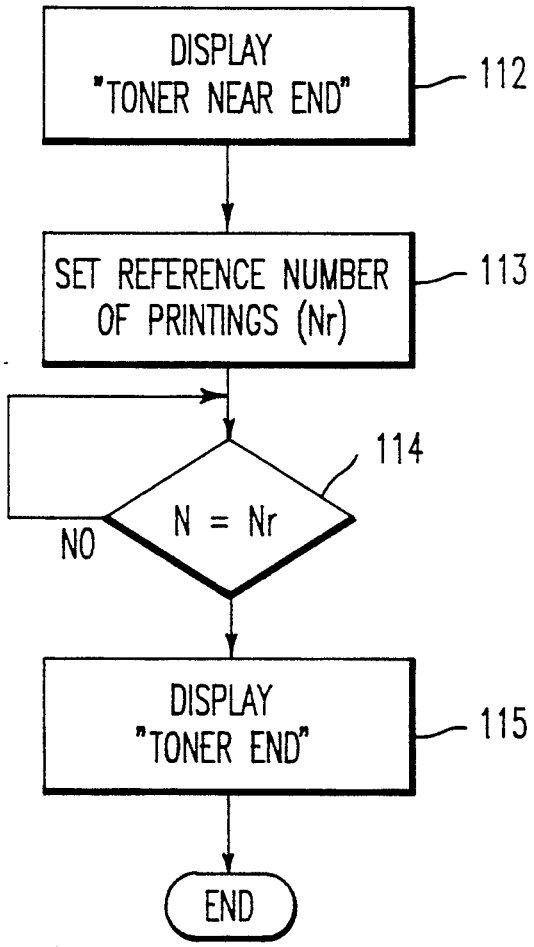

When the recording unit is driven, the CPU 70 of the control carries out processes in accordance with the flow charts shown in FIGS. 6A and 6B.

Referring to FIG. 6A, when the recording unit repeatedly records images in accordance with an electrophotographic process, step 102 determines, based on detection signals supplied from the toner sensor 28, whether or not the amount of toner $V_t$ in the storage part 27 of the developing unit 7 is equal to or less than the predetermined amount $V_{to}$. The toner is supplied from the developing unit 7 to the photosensitive belt 1 while printing images. Then, when step 102 detects that the amount of the toner $V_t$ is equal to or less than the predetermined amount $V_{to}$, step 103 starts to drive the ejecting mechanism 22 in the CTM 20, the conveyor mechanism 23 and the conveyor 30 of the supply mechanism 24 in the developing unit 7. Thus, the toner in the toner supply chamber 8 of the CTM 20 is conveyed to the developing unit 7. In the developing unit, the toner is conveyed in the groove 31*a* of the gutter member 31 by the screw 30.

A previously measured time $T_o$, required for filling the groove 31*a* of the gutter member 31 with the toner, has been stored in the the RAM 72 (or ROM 71). After step 103, step 104 activates a timer (T) so that the timer starts. Then step 105 determines whether or not a time T measured by the timer has reached the predetermined time $T_o$ stored in the RAM 72. The toner is conveyed in the groove 31*a* of the gutter unit 31 until the time T in the timer reaches the predetermined time $T_o$. Then when step 105 determines that the time T in the timer has reached the predetermined time $T_o$, step 106 turns on and off (1 cycle) the solenoid actuator 35. When the solenoid actuator 35 is turned on and off once, the gutter member 31 is pivoted on the shaft 32 and turned to the original position. At this time, the toner filling the groove 31*a* of the gutter member 31 falls to the storage part 27 of the developing unit 7. That is, the constant amount of toner is supplied from the gutter member 3 to the developing unit 7.

After this, step 107 samples the detection signal output from the toner detector 28 and then the amount of toner $V_t(i)$ stored in the storage part 27 of the developing unit 7 is detected based on the detection signal sampled at an i-th period. Step 108 determines whether or not the amount of toner $V_t(i)$ has reached a maximum amount $V_{tm}$, and then step 109 determines whether or not the amount of toner $V_t(i)$ is greater than the amount of toner $V_t(i-1)$ obtained at the previous (i−1)-th period.

The above steps 104, 105, 106, 107, 108 and 109 are repeatedly carried out, so that the constant amount of toner is supplied from the CTM 20 to the developing unit 7. As the amount of toner stored in the storage part 27 of the developing unit 7 increases while the toner is supplied thereto, step 109, in the above process, usually determines that the amount of toner $V_t(i)$ is greater than the amount of toner $V_t(i-1)$ obtained at the previous (i−1)-th period.

When the amount of the toner $V_t(i)$ in the storage part 27 of the developing unit 7 reaches the maximum amount $V_{tm}$, the result obtained in step 108 becomes YES. In this case, step 111 stops to drive the ejecting mechanism 22 in the toner supply chamber 8 of the CTM 20, the conveyor mechanism 23 and the conveyor 30 of the supplying mechanism 24. That is, the toner stops to be supplied to the developing unit 7. Then, the process returns to step 102, so that the processes described above is carried out.

When the toner in the toner supply chamber 8 of the CTM 20 is used up, the amount of toner in the storage part 27 of the developing unit 7 does no increase. Thus, step 109 determines that the amount of toner $V_t(i)$ is not greater than the amount of toner $V_t(i-1)$ obtained at the previous (i−1)-th period. Step 110 stops to drive the ejecting mechanism 22 in the toner supply chamber 8 of the CTM 20, the conveyor mechanism 23 and the conveyor 30 of the supplying mechanism 24. Then the process proceeds to step 112 shown in FIG. 6B. In this case, as the CPU 70 determines that the toner supply chamber 8 is empty, step 112 displays a message "TONER NEAR END" on the display unit 78. Due to the message displayed on the display unit 78, the user can recognize nearness to a time at which the CTM 20 must be replaced. After this, step 113 sets the reference number of printings ($N_r$) in a register. The reference number of printings ($N_r$) is defined as a number of printings which can be performed by using toner remaining in the storage part 27 of the developing unit 7. Then the number of printings (N) are counted, and step 114 determines whether or not the number of printings (N) has reached the reference number ($N_r$) set in the register. When the number of printings (N) reaches the reference number ($N_r$), the CPU 70 determines that the toner in the storage part 27 of the developing unit 7 is empty. Thus, step 115 displays a message "TONER END" on the display unit 78. When the message "TONER END" is displayed on the display unit 78, the user replaces the CTM 20.

In the first embodiment, the amount of toner $V_{to}$ used as a reference amount for determining a time for starting to drive the conveyor mechanism 23 and the like, and the maximum amount $V_{tm}$ used as a reference amount for determining a time stopping to drive the conveyor mechanism 23 and the like are decided based on the size of the storage part 27 of the developing unit 7.

According to the first embodiment, only when the amount of toner is equal to or less, than the predetermined amount $V_{to}$, is the toner supplied from the CTM 20 to the developing unit 7. Thus, neither too much nor too little toner can be supplied to the developing unit 7. In addition, when the gutter member 31 extending in the main scanning direction is filled with toner, the toner falls from the gutter member 31 to the storage part 27 of the developing unit 7. Thus, the toner can be stored in the developing unit 7 so as to be uniformly distributed in the main scanning direction.

Further, the message "TONER NEAR END" meaning that there is little toner remaining in the developing unit 7, and the message "TONER END" meaning that the developing unit 7 is empty are successively displayed on the display unit 78. Thus the user can easily recognize a time at which the CTM 20 must be replaced.

Figure 7:
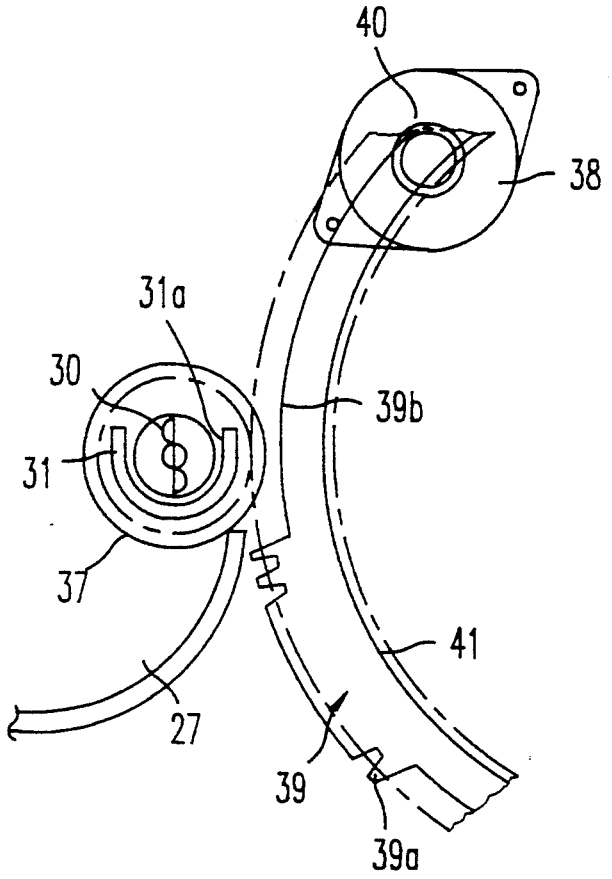
FIG. 7 is a diagram illustrating another supplying mechanism for supplying the toner to the developing unit.

FIG. 7 shows another example of a mechanism for moving the gutter member 31.

Referring to FIG. 7, a gear 37 is fixed at an end of the gutter member 31 so as to be rotated around the same axis as the screw 30 provided in the groove 31*a* of the gutter member 31. A sector gear 39 is provided near the end of the gutter member 31. The sector gear 39 has a convex side and a concave side The convex side of the sector gear 39 has a first part on which outside teeth 39*a* are formed and a second part 39*b* having no teeth. Inside teeth 41 are formed on the concave side of the sector gear 39. A gear 40 mounted on a shaft of a motor 38 is engaged with the inside teeth 41 of the sector gear 39. When the toner is conveyed in the groove 31*a* by the screw 30, the motor 40 is driven so as to cause the second part 39*b* of the sector gear 39 to face the gear 37. When the the groove 31*a* is filled with the toner, the outside teeth 39*a* of the first part of the sector gear 39 are engaged with the gear 37 so that the gutter member 31 is rotated by the rotation of the sector gear 39. Then the toner in the groove 31*a* of the gutter member 31 falls to the storage part 27 of the developing unit 7.

Figure 2:
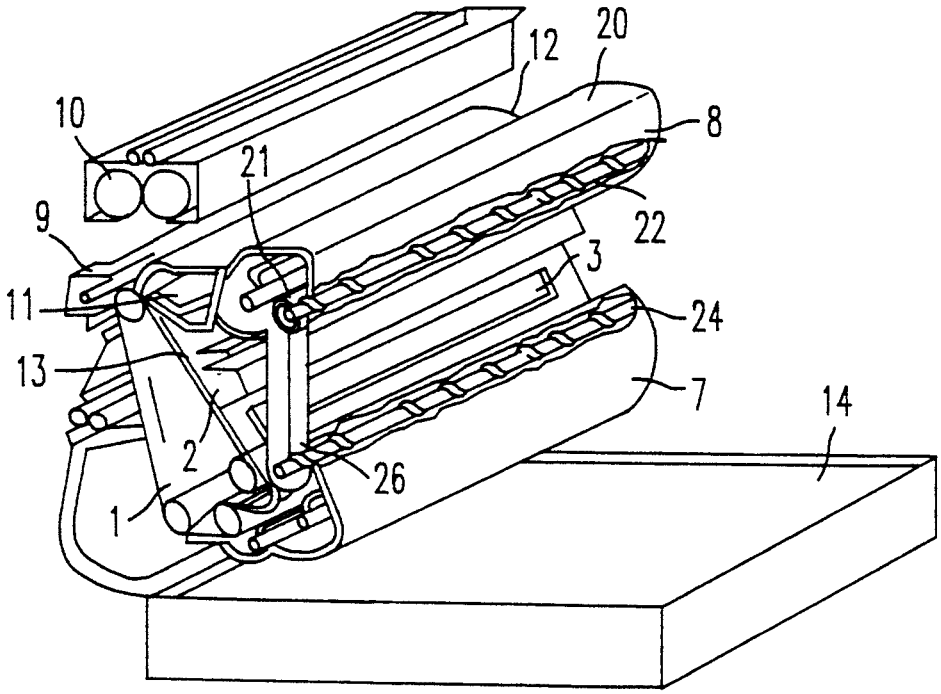
FIG. 2 PRIOR ART
FIG. 2 is a perspective view illustrating another recording unit having a CTM.
Figure 8:
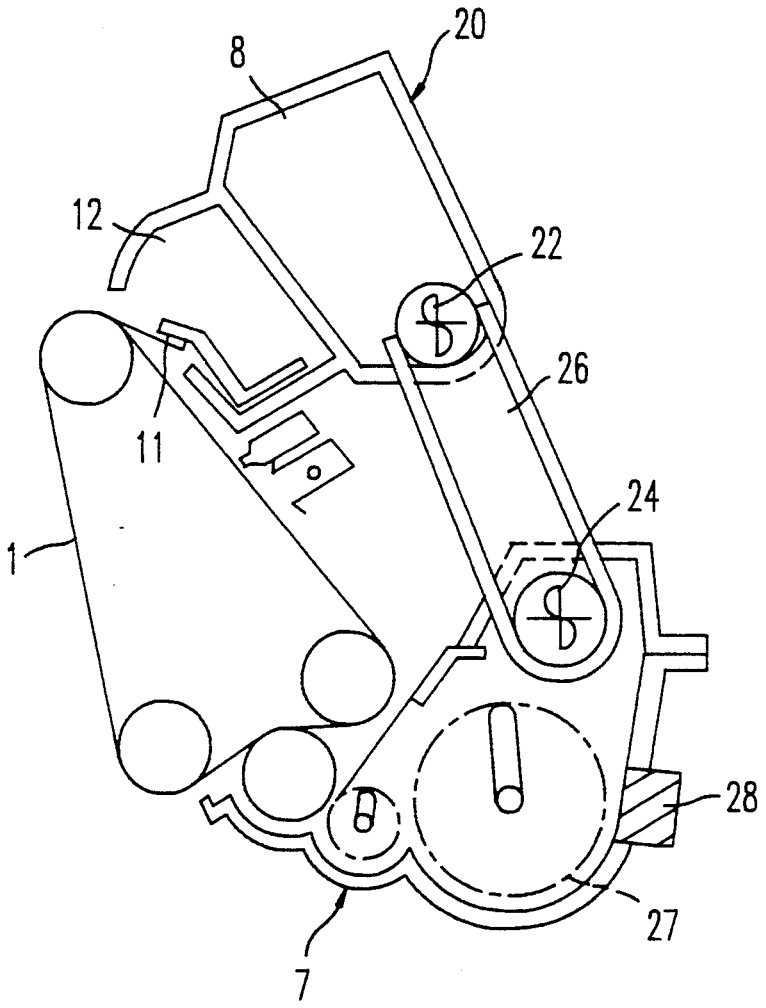
FIG. 8 is a cross sectional view illustrating another structure of a recording unit.

The control system described above can also be applied to a recording unit having a structure shown in FIG. 8. The recording unit shown in FIG. 8 corresponds to that shown in FIG. 2. In FIG. 8, those parts which are the same as those shown in FIG. 2 are given the same references numbers. In this case, the toner ejected from the outlet of the toner supply chamber 8 of the CTM 20 falls to the developing unit 7 via the duct 26. The toner sensor 28 is mounted on the storage part 27 of the developing unit 7 in the same manner as that shown in FIG. 3. Processes the same as those in accordance with the flow charts shown in FIGS. 6A and 6B are carried out.

A description will now be given of a second embodiment of the present invention with reference to FIGS. 9 through 12.

Figure 9:
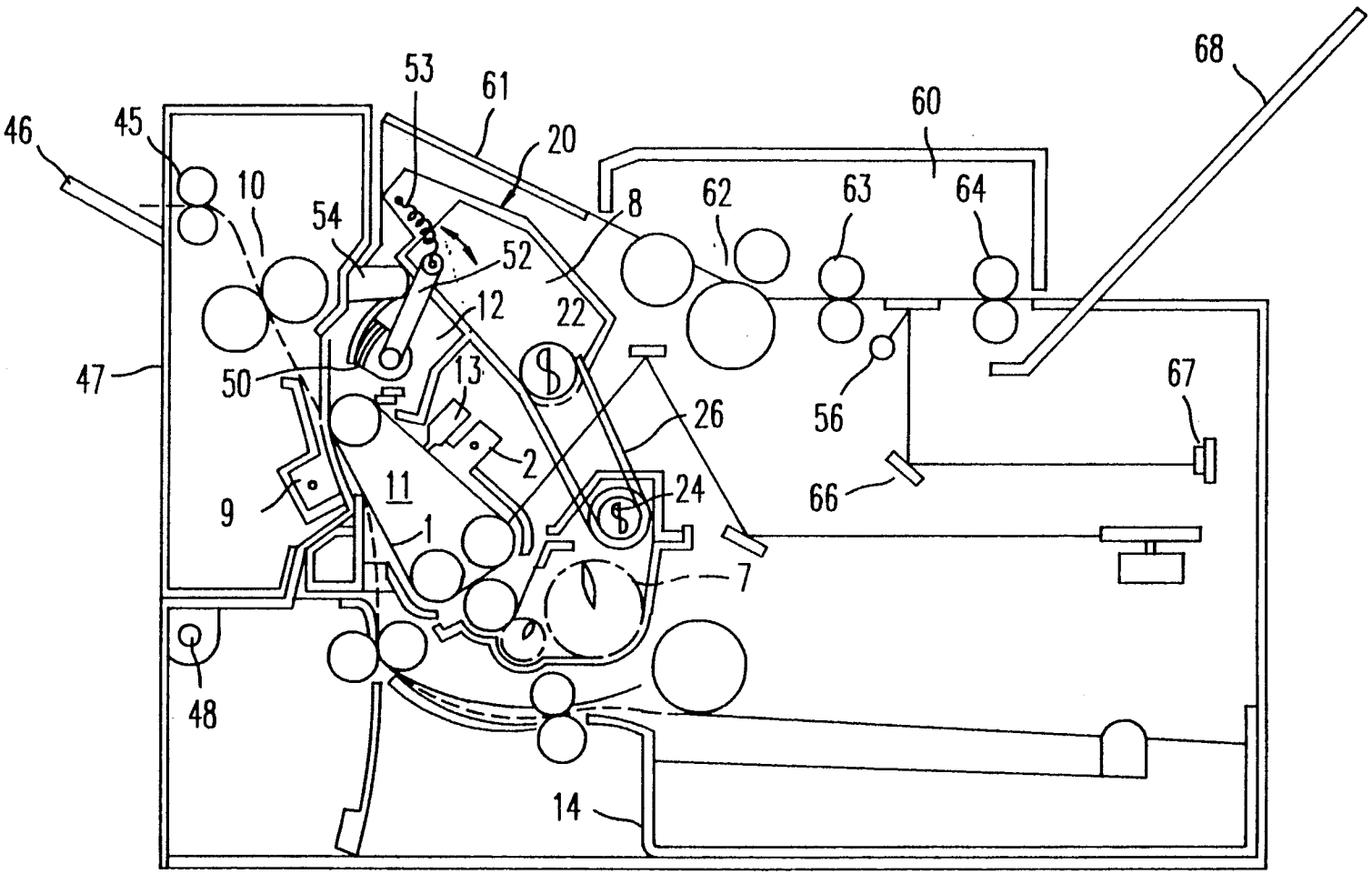
FIGS. 9 and 10 are cross sectional views illustrating a recording unit according to a second embodiment of the present invention.

FIG. 9 shows a facsimile machine including a recording unit according to the second embodiment. In the second embodiment, a movable shutter 50 is provided at an opening of the toner withdrawing chamber 12 of the CTM 20. As a result, when the CTM 20 having the withdrawing chamber 12 filled with the scrap toner is changed to a new one, the scrap toner is prevented by the shutter 50 from scattering from the opening of the toner withdrawing chamber 12. In FIG. 9, those parts which are the same as those shown in FIG. 8 are the same reference numbers.

Figure 10:
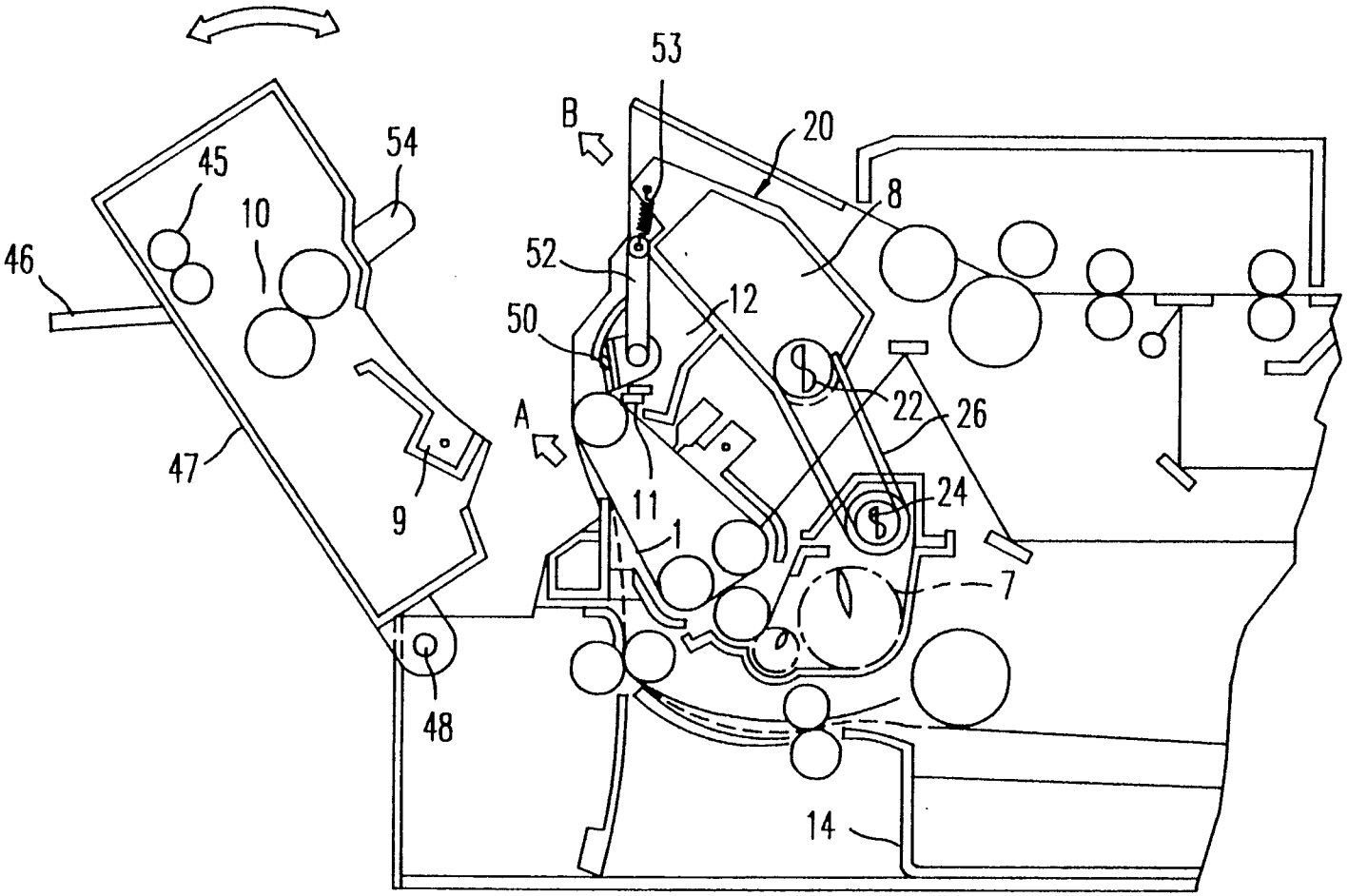

Referring to FIG. 9, a cover 47 housing the transfer charger 9, a fusing unit 10, eject rollers 45 and an eject tray 46 is provided at an end of the housing of the facsimile machine. The cover 47 can be rotated around a shaft 48, so that the housing of the facsimile machine is opened or closed by the rotation of the cover 47, as shown in FIG. 10. When the life of the photosensitive belt 1 is completed, the photosensitive member unit (including the photosensitive belt 1, rollers and the like) is replaced under a condition in which the cover 47 is opened. The photosensitive member unit is removed from the housing by pulling it in a direction shown by an arrow A in FIG. 10. When the toner in the toner supply chamber 8 of the CTM 20 is used up, the CTM 20 is replaced under a condition in which the cover 47 is opened. The CTM is removed from the housing by pulling it in a direction shown by an arrow B in FIG. 10. When the CTM 20 is pulled in the direction shown by the arrow B, the shutter 50 provided at the opening of the toner withdrawing chamber 12 of the CTM 20 is automatically closed. Thus, the scrap toner in the toner withdrawing chamber 12 is prevented from scattering from the opening through which the cleaning blade 22 is exposed.

Figure 11:
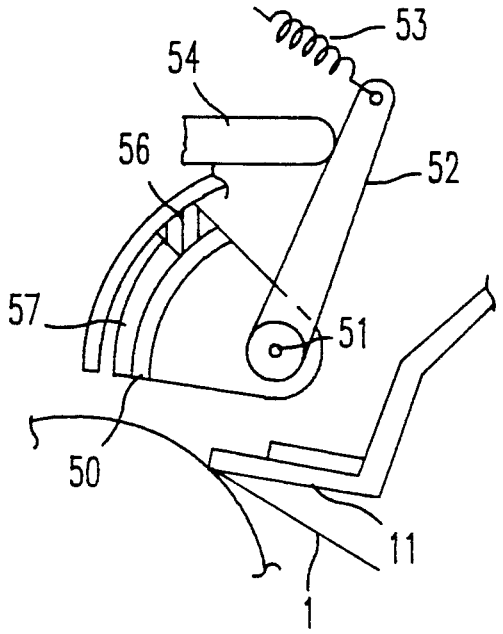
FIGS. 11 and 12 are diagrams illustrating a shutter provided in a cleaning toner magazine (CTM).
Figure 12:
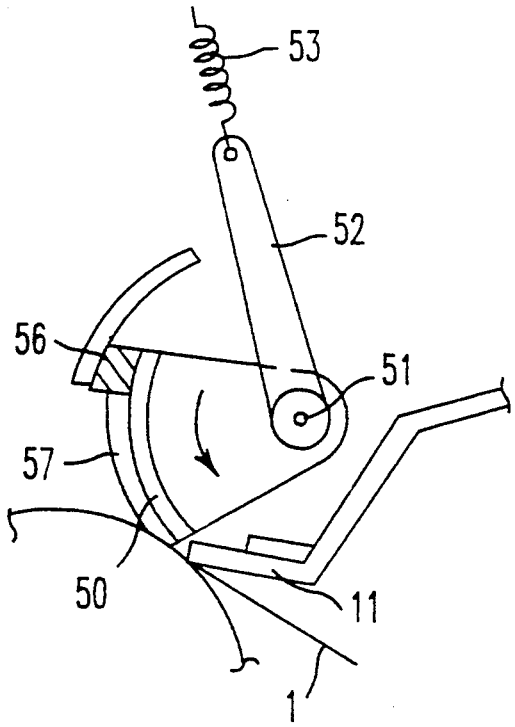

The shutter 50 is rotatably supported on a shaft 51. A first end of an arm 52 is fixed to the shutter 50. A second end of the arm 52 is provided with a spring 53. The spring 53 pulls the second end of the arm 52 so that the shutter 50 is closed. The cover 47 is provided with a projection member 54. When the cover 47 is closed, the projection member 54 pushes the arm 52 so that the shutter 50 is opened as shown in FIG. 11. In this state, the residual toner scraped by the cleaning blade 11 from the photosensitive belt 1 is raked into the toner withdrawing chamber 12 of the CTM 20 via the opening. When the cover 47 is opened, the arm 52 is rotated by the force of the spring 53 so that the shutter 51 is closed as shown in FIG. 12. Thus, when the CTM 20 is removed from the housing, the toner in the toner withdrawing chamber 12 of the CTM 20 is prevented from scattering by the shutter 50.

A seal member 56 and a sheet shaped magnet 57 formed on rubber are adhered to a surface of the shutter 50. The seal member 56 is in contact with an inside of a wall of the toner withdrawing chamber 12 so that the scrap toner is prevented from scattering via a slit between the shutter 50 and the inside of the wall of the toner withdrawing chamber 12. The sheet shaped magnet 57 absorbs the scrap toner adhered to the cleaning blade 11.

In the facsimile machine shown in FIG. 9, a document reading unit 60 for optically reading documents is arranged at a top of the housing of the facsimile machine. The documents set on a document tray 61 are fed one by one by separating rollers 62. When each document is fed by feed rollers 63 and 64, a light source 65 irradiates it and then a light reflected by each document is led to an optical sensor 67 (CCD) via a mirror 66. The optical sensor 67 outputs image signals corresponding to the light input thereto. Each of the documents optically read by the reading unit 60 is ejected to an ejecting tray 68.

According to the second embodiment, when the cover 47 is opened to replace the CTM 20, the shutter 50 of the CTM 20 is closed in a state where the slit between the shutter and the wall of the toner withdrawing chamber 12 is filled with the seal member 56, and a leading end of the sheet shaped magnet 57 is brought into contact with the cleaning blade 11. Thus, when the CTM 20 is replaced, the scrap toner in the toner withdrawing chamber 12 of the CTM 20 is prevented from scattering from the opening. When the cover 47 is closed after the CTM 20 has been changed, the shutter 50 of the toner withdrawing chamber 12 of the CTM 20 is automatically opened. That is, a state where the residual toner can be withdrawn from the photosensitive belt 1 is automatically maintained.

The present invention is not limited to the aforementioned embodiments, and variations and modifications may be made without departing from the scope of the claimed invention.

What is claimed is:

1. A recording apparatus for recording images in accordance with an electrophotographic process, said recording apparatus comprising:

a photosensitive member;

an image forming unit for optically forming a latent image on a surface of said photosensitive member;

a developing unit for developing the latent image by supplying developer to the surface of said photosensitive member so that a visible image corresponding to the latent image is formed on the surface of said photosensitive member;

a transfer unit for transferring the visible image from the photosensitive member to a recording sheet;

a magazine unit having a first chamber for storing developer and a second chamber for storing scrap developer which are integrated with each other and adjoining, the second chamber facing the surface of said photosensitive member and being provided with a cleaning unit exposed from an opening formed on said magazine unit, residual developer being scraped from said photosensitive member by said cleaning unit immediately after a process in said transfer unit, said residual developer entering, as the scrap developer, into said second chamber via the opening, and said magazine unit being detachably mounted in a housing of said recording apparatus;

a supplying mechanism for supplying the developer from the first chamber of said magazine unit to said developing unit, wherein said supplying mechanism comprises:

a first mechanism, provided in the first chamber of said magazine unit, for ejecting the developer from said first chamber of said magazine unit via an outlet formed on said magazine unit;

a second mechanism, provided between the outlet of said magazine unit and an inlet formed on said developing unit, for conveying the developer ejected via the outlet of said magazine to the inlet of said developing unit, the developer entering to said developing unit via the inlet; and a third mechanism, provided in said developing unit, for supplying the developer to said developing unit at a constant rate so that an amount of developer supplied from said developing unit to the surface of said photosensitive member is uniformly distributed, wherein said third mechanism comprises:

a gutter member having a groove for accommodating the developer passing through the inlet;

a screw, provided in said groove of said gutter member, for conveying the developer from a first end of said groove to a second end of said groove; and a rotation mechanism for rotating said gutter member at a predetermined angle;

detecting means for detecting that an amount of developer in said developing unit is equal to or less than a predetermined amount; and control means for activating said supplying mechanism when said detecting means detects that the amount of developer in said developing unit is equal to or less than the predetermined amount, wherein said control means comprises:

memory means for storing a reference time which is a time required for filling said groove of said butter member with the developer;

timer means for measuring a time starting from a time at which said screw starts to convey the developer in said gutter member; and activating means for activating said rotation mechanism when the time measured by said timer means reaches the reference time stored in said memory means.

2. A recording apparatus as claimed in claim 1, wherein said rotation mechanism comprises:

a solenoid actuator having a plunger capable of moving forward and backward;

an arm rotatably supported by a shaft, a first end of which is connected to said gutter member, and an end of the plunger of said solenoid actuator being slidably connected to said arm at a position between a second end of said arm and the shaft supporting said arm; and a spring connected to the second end of said arm, said spring pulling said arm in a direction opposite to a direction in which the plunger of said solenoid actuator pulls said arm.

3. A recording apparatus as claimed in claim 1, wherein said rotation mechanism comprises:

a first gear mounted on an end of said gutter member so that said first gear has almost the same axis as that around which said gutter member is rotated;

a second gear engaged with said first gear; and a driving unit for driving said second gear.

4. A recording apparatus for recording images in accordance with an electrophotographic process, said recording apparatus comprising:

a photosensitive member;

an image forming unit for optically forming a latent image on a surface of said photosensitive member;

a developing unit for developing the latent image by supplying developer to the surface of said photosensitive member so that a visible image corresponding to the latent image is formed on the surface of said photosensitive member;

a transfer unit for transferring the visible image from the photosensitive member to a recording sheet;

a magazine unit having a first chamber for storing developer and a second chamber for storing scrap developer, the second chamber being provided with a cleaning unit exposed from an opening formed on said magazine unit, and residual developer scraped from said photosensitive member by said cleaning unit immediately after a process in said transfer unit entering, as scrap developer, into said second chamber via the opening, said magazine unit being detachably mounted in a housing of said recording apparatus;

a first mechanism, provided in the first chamber of said magazine unit, for ejecting the developer from said first chamber of said magazine unit via an outlet formed on said magazine unit;

a second mechanism, provided between the outlet of said magazine unit and an inlet formed on said developing unit, for conveying the developer ejected via the outlet of said magazine to the inlet of said developing unit, the developer entering said developing unit via the inlet;

a third mechanism, provided in said developing unit, for suppling the developer to said developing unit at a constant rate, said third mechanism having a gutter member having a groove for accommodating the developer passing through the inlet, a screw, provided in said groove of said gutter member, for conveying the developer from a first end of said groove to a second end of said groove, and a rotation mechanism for rotating said gutter member at a predetermined angle;

memory means for storing a reference time that is a time required for filling said groove of said gutter member with the developer;

timer means for measuring a time starting from a time at which said screw starts to convey the developer in said gutter member; and activating means for activating said rotation mechanism when the time measured by said timer means reaches the reference time stored in said memory means.

5. A recording apparatus as claimed in claim 4, wherein said rotation mechanism comprises:

a solenoid actuator having a plunger capable of moving forward and backward;

an arm rotatably supported by a shaft, a first end of said arm being connected to said gutter member, and an end of the plunger of said solenoid actuator being slidably connected to said arm at a position between a second end of said arm and the shaft supporting said arm; and a spring connected to the second end of said arm, said spring pulling said arm in a direction opposite to a direction in which the plunger of said solenoid actuator pulls said arm.

6. A recording apparatus as claimed in claim 4, wherein said rotation mechanism comprises:

a first gear mounted on an end of said gutter member so that said first gear has almost the same axis as that around which said gutter member is rotated;

a second gear engaged with said first gear; and a driving unit for driving said second gear.

7. A recording apparatus as claimed in claim 4, wherein said magazine unit and said developing unit are arranged in a approximately vertical direction, and wherein said second mechanism has a duct connecting the outlet of said magazine unit and the inlet of said developing unit, the developer ejected from the outlet of said magazine unit falling toward the inlet of said developing unit via said duct so that developer is supplied to said developing unit.

* * * * *

UNITED STATES PATENT AND TRADEMARK OFFICE

CERTIFICATE OF CORRECTION

PATENT NO. : 5,268,720

DATED : December 7, 1993

INVENTOR(S) : Hiroshi Saitoh et al.

It is certified that error appears in the above-indentified patent and that said Letters Patent is hereby corrected as shown below:

On the title page, Item [75],

The third inventor's city should read: --Isehara--

Signed and Sealed this

Third Day of May, 1994

Bruce Lehman

*Attest:*

BRUCE LEHMAN

*Attesting Officer*

*Commissioner of Patents and Trademarks*